US006115687A

United States Patent [19]

Tanaka et al.

[11] Patent Number: 6,115,687

[45] Date of Patent: Sep. 5, 2000

[54] SOUND REPRODUCING SPEED CONVERTER

[75] Inventors: Naoya Tanaka, Yokohama; Hiroaki Takeda, Kawasaki, both of Japan

[73] Assignee: Matsushita Electric Industrial Co., Ltd., Osaka, Japan

[21] Appl. No.: 09/091,823

[22] PCT Filed: Nov. 10, 1997

[86] PCT No.: PCT/JP97/04077

§ 371 Date: Jul. 1, 1998

§ 102(e) Date: Jul. 1, 1998

[87] PCT Pub. No.: WO98/21710

PCT Pub. Date: May 22, 1998

[30] Foreign Application Priority Data

Nov. 11, 1996 [JP] Japan ..... 8-312593

[51] Int. Cl.[7] ..... G10L 13/02

[52] U.S. Cl. ..... 704/269; 704/262

[58] Field of Search ..... 704/262, 268, 704/207, 258, 208, 200, 269, 266, 267, 203

[56] References Cited

U.S. PATENT DOCUMENTS

| | | | |
|---|---|---|---|
| 4,577,343 | 3/1986 | Oura | 704/258 |
| 4,937,868 | 6/1990 | Taguchi | 395/2.29 |
| 5,369,730 | 11/1994 | Yajima | 704/267 |
| 5,630,013 | 5/1997 | Suzuki et al. | 704/216 |
| 5,765,127 | 6/1998 | Nishiguchi et al. | 704/208 |
| 5,832,437 | 11/1998 | Nishiguchi et al. | 704/268 |
| 5,847,303 | 12/1998 | Matsumoto | 84/610 |
| 5,950,152 | 9/1999 | Arai et al. | 704/207 |
| 5,991,724 | 9/1999 | Kojima et al. | 704/266 |
| 5,991,725 | 9/1999 | Asghar et al. | 704/270 |

FOREIGN PATENT DOCUMENTS

| | | | |
|---|---|---|---|
| 0608833 | 8/1994 | European Pat. Off. | G10L 3/02 |
| 0680033 | 11/1995 | European Pat. Off. | G10L 3/00 |
| 1267700 | 10/1989 | Japan | G10L 3/02 |
| 7077999 | 3/1995 | Japan | G10L 3/02 |
| 7319496 | 12/1995 | Japan | G10L 3/02 |
| 8-22300 | 1/1996 | Japan | G10L 9/14 |
| 8137491 | 5/1996 | Japan | G10L 3/02 |
| 8202397 | 8/1996 | Japan | G10L 9/14 |
| 9152889 | 6/1997 | Japan | G10L 3/02 |

OTHER PUBLICATIONS

An article by Morita et al., entitled "Time–Scale Modification Algorithm For Speech By Use of Pointer Interval Control Overlap and Add (PICOLA) and its Evaluation", Proceeding of National Meeting of the Acoustic Society of Japan, 1–4–14, Oct. 1986.

An English Language abstract of Morita et al. article.

An English Language abstract of JP 7–077999.

An English Language abstract of JP 1–267700.

An English Language abstract of JP 9–152889.

An English Language abstract of JP 8–137491.

An English Language abstract of JP 8–202397.

An English Language abstract of JP8–022300.

An English Language abstract of JP 7–319496.

*Primary Examiner*—Richemond Dorvil

*Attorney, Agent, or Firm*—Greenblum & Bernstein, P.L.C.

[57] ABSTRACT

An apparatus and method that reproduces a voice signal at different rates without a change in pitch. Neighboring voice waveforms having a same length and minimum form differences from an input voice signal are selected and overlapped. An output voice waveform is then generated that is rate converted by replacing a part of the voice waveform of the input voice signal with the overlapped voice waveforms, or, alternatively, by inserting the overlapped voice waveforms into the voice waveform of the input voice signal.

15 Claims, 12 Drawing Sheets

SOUND REPRODUCING SPEED CONVERTER

TECHNICAL FIELD

The present invention relates to an apparatus for converting a voice reproducing rate to reproduce digitized voice signals at an arbitrary rate without transforming (changing) a pitch of voice.

In this specification(description), "voice" and "voice signal" are used to represent all acoustic signals generated from instruments and others, not only voice uttered from a person.

BACKGROUND ART

As a method to convert a reproducing rate into an arbitrary rate without transforming a pitch of voice, PICOLA (Pointer Interval Control Overlap and Add) method is known. The principle of PICOLA method is introduced by "Time-Scale Modification Algorithm for Speech by Use of Pointer Interval Control Overlap and Add (PICOLA) and Its Evaluation" written by MORITA, Naotaka and ITAKURA, Fumitada in Proceeding of National Meeting of The Acoustic Society of Japan 1-4-14 (October, 1986).

And, the application of PICOLA method for voice signals divided into frames to convert a reproducing rate with fewer buffer memories is disclosed in Japanese unexamined patent publication No.8-137491.

FIG. 9 illustrates a block diagram of a conventional apparatus for converting a voice reproducing rate in PICOLA method. In the apparatus for converting a voice reproducing rate illustrated in FIG. 9, digitized voice signals are recorded in recording media 1, and framing section 2 fetches a voice signal in a frame of a predetermined length LF sample from recording media 1. The voice signal fetched by framing section 2 is provided into pitch period calculating section 6 along with stored in buffer memory 3 temporarily. Pitch period calculating section 6 calculates pitch period Tp of the voice signal to provide it into waveform overlapping section 4 along with storing a pointer of processing start position into buffer memory 3. Waveform overlapping section 4 overlaps waveforms of voice signals stored in buffer memory 3 using the pitch period of the input voice, then outputs the overlapped waveform into waveform synthesizing section 5. Waveform synthesizing section 5 synthesizes an output voice signal waveform from the voice signal waveform stored in buffer memory 3 and the overlapped waveform processed at waveform overlapping section 4 to provide the output voice.

In this apparatus for converting a voice reproducing rate, a reproducing rate is converted without transforming a pitch according to the process in the following.

First, a processing method for high rate reproducing is explained with FIG. 10 and FIG. 11. In the figures, P0 is a pointer indicating a head of a waveform overlap processing frame. In the waveform overlap processing, a processing frame is a LW sample with a length of two periods of voice pitch period Tp. And, when a rate of input voice is 1 and a desired reproducing rate is given r, L is the number of samples given by the following formulation.

$$L=Tp\{1/(r-1)\} \quad (1)$$

L is a sample corresponding to a length of output waveform (c), and an input voice of Tp+L sample is reproduced as an output voice of L sample as mentioned later. Accordingly, r=(Tp+L)/L is given, then the formulation (1) is introduced.

An input voice fetched from recording media 1 by framing section 2 is stored in buffer memory 3. Concurrently, pitch period calculating section 6 calculates pitch period Tp of the input voice to input it to waveform overlapping section 4. And, pitch period calculating section 6 calculates L from pitch period Tp using the formulation (1), determines P0' that is a starting position for next processing and provides it into buffer memory 3 as a pointer in the buffer memory.

Waveform overlapping section 4 fetches a waveform of waveform overlap processing frame LW (=2Tp) sample from a processing starting point indicated by pointer P0 from buffer memory 3, decreases the first part of the processing frame (waveform A) in the time axis direction and increases the latter part of the processing frame (waveform B) in the time axis direction according to the the triangle window function, adds waveform A and waveform B, then calculates overlapped waveform c.

Waveform synthesizing section 5 removes the waveform of the waveform overlapping processing frame (waveform A+waveform B) from the input voice waveform and insert the overlapped waveform (waveform c) illustrated in FIG. 10 instead of the removed waveform. Then, input voice waveform D is added the overlapped waveform until P0' indicating a position of (P0+Tp+L) point (which is P1 indicating a position of a head+L point in waveform C on the synthesized waveform). In addition, P1 exists in waveform C when r>2, in this case, waveform C is output until the position indicated by P1.

As a result, the length of synthesized output waveform (c) is L sample, then an input voice of Tp+L sample is reproduced as an output voice of L sample. Next waveform overlap processing is started from P0' point on the input waveform.

FIG. 11 illustrates the relation of voice signals stored in buffer memory 3 and framing by framing section 2 in the above processing explained using FIG. 10.

Originally, a buffer length necessary for the waveform overlap processing in buffer memory 3 is two periods of maximum pitch period Tp max of input voice. However, since input voice is divided into samples of a predetermined frame length LF to input, the processing starting position P0 locates at an arbitrarily position in the first frame of input voice and the buffer length should be an integer times of input frame length. Accordingly, the buffer length is the minimum value in multiples of LF over (LF+2Tp max). For instance, when the input frame length LF is 160 samples and the maximum value of pitch period Tp max is 145, the buffer length needs 3LF=480 samples.

In the processing in the buffer memory, the content of the buffer memory is shifted each time of input of LF sample and the waveform overlapping is processed only when the processing starting position P0 is entered in the first frame. In other time, input signals are provided as output signals without processing.

Next, a method for low rate reproducing is explained with FIG. 12.

As well as high rate reproducing, P0 is a pointer indicating a head of a waveform overlap processing frame. In the waveform overlap processing, a processing frame is a LW sample with a length of two periods of voice pitch period Tp. And, when a rate of input voice is 1 and a desired reproducing rate is given r, L is the number of samples given by the following formulation.

$$L=Tp\{r/(1-r)\} \quad (2)$$

In the case of low rate reproducing, an input voice of L sample is reproduced as an output voice of Tp+L sample as mentioned later. Accordingly, r=L/(Tp+L) is given, then the formulation (2) is introduced.

Waveform overlapping section 4 increases the first part of the processing frame (waveform A) in the time axis direction, decreases the latter part of the processing frame (waveform B) in the time direction accordingly to the triangle window function, adds waveform A and waveform B, and calculates overlapped waveform c.

Waveform synthesizing section 5 inserts the overlapped waveform (waveform C) between waveform A and waveform B of the input signal waveform (a) illustrated in FIG. 12. Then, the input voice waveform B is added to the overlapped waveform until P0' indicating a position of (P0+L) point (which is P1 indicating a position of a head+L point of the waveform C on the synthesized waveform). When r>0.5, P1 is not on input voice waveform B but exists on waveform D continued from the overlapped processing frame, in this case, waveform D is output until the position indicated by P0'.

As a result, the length of synthesized output waveform (C) is Tp+L sample, then an input voice of L sample is reproduced as an output voice of Tp+L sample. And, next waveform overlap processing is started from P0' point of the input waveform.

The relation of voice signals stored in buffer memory 3 and framing by framing section 2 is the same as that of high rate reproducing.

By the way, in the apparatus for converting a voice reproducing rate described above, a pitch period of input voice is obtained then the overlapping of waveform is executed on the basis of the pitch period. An input voice divided in the pitch period is called a pitch waveform, and since generally pitch waveforms have high similarity between each other, they are appropriate to use for waveform overlap processing.

However, if a calculation error occurs in a pitch period calculation the difference between neighboring pitch waveforms increases, which brings the problem that the quality of output voice after waveform overlapping decreases. As a primary cause to generate a calculation error of a pitch period, the following factors are considered. Generally, the calculated pitch period represents a certain interval of input voice (called pitch period analysis interval). When the pitch period varies drastically in the pitch period analysis interval, the defference between the calculated pitch period and the actual pitch period increases. Accordingly, to suppress the decreases of quality of output voice, it is necessary to obtain the most appropriate pitch waveform at the position of waveform overlap processing position.

DISCLOSURE OF INVENTION

The present invention is carried out, taking into account the facts described above, and has the purpose to provide an apparatus for converting a voice reproducing rate capable of decreasing the distortion caused by overlapping waveforms to convert a voice reproducing rate, and of improving the quality of output voice.

To achieve the purpose described above, in the present invention, a voice reproducing rate is converted by selecting two waveforms in input voice signals or input residual signals in which the form difference between two neighboring waveforms of the same length is the minimum to compute overlapped waveform, then replacing it with a part of the input voice signals or the input residual signals or inserting it into the input voice signals or the input residual signals.

According to the present invention, it is possible to select waveforms to overlap exactly, which allows to improve the quality of the rate-converted voice.

And, in the present invention, output information from a voice coding apparatus is used by combing a decoder of voice coding apparatus for coding voice signals by dividing them into a linear predictive coefficientss representing spectrum information, pitch period information and voice source information representing a predictive residual.

According to the present invention, by using output information from a voice coding apparatus, it is possible to largely reduce the calculation cost in converting a reproducing rate of coded voice signals.

In the present invention, an apparatus for converting a voice reproducing rate comprising a buffer memory in which digitized input voice signals are stored temporarily, a waveform overlapping section for overlapping voice waveforms stored in the buffer memory and a waveform synthesizing section for synthesizing an output voice waveform from the input voice waveform in the buffer memory and the overlapped voice waveform, a waveform fetching section to fetch neighboring two waveforms of the same length from the buffer memory, and a form difference calculating section to calculate a form difference between those two voice waveforms fetched by the waveform fetching section are prepared, where the waveform overlapping section selects two voice waveforms having the minimum form difference calculated by the form difference calculating section to overlap.

And, in the present invention, a linear predictive analysis section to calculate the linear predictive coefficientss representing spectrum information of an input voice signal, an inverse filter to calculate a predictive residual signal from the input voice signal using the calculated linear predictive coefficientss and a synthesis filter to synthesize a voice signal from the prediction residual signal using the linear predictive coefficientss are prepared, where the predictive residual signal calculated by the inverse filter is stored in the buffer memory and the predictive residual signal calculated by the waveform synthesizing section is output into the synthesis filter.

Accordingly, reproducing rate conversion processing can be executed using a predictive residual signal easy to decide a pitch waveform, which allows to fetch the pitch waveform exactly. That improves the quality of the reproduced voice.

And, in the present invention, a voice coding apparatus for coding voice signals by dividing them into a linear predictive coefficientss representing spectrum information, pitch period information and voice source information representing a prediction residual is combined, where the voice source information representing a prediction residual is stored in the buffer memory temporarily and the waveform fetching section determines the range of length of a voice waveform fetched from the buffer memory on the basis of the pitch period information.

In the present invention, a linear predictive analysis section to calculate the linear predictive coefficientss representing spectrum information of an input voice signal, an inverse filter to calculate a predictive residual signal from the input voice signal using the calculated linear predictive coefficientss, a linear predictive coefficientss interpolating section to interpolate the linear predictive coefficientss and a synthesis filter to synthesize a voice signal from the predictive residual signal using the linear predictive coefficientss are prepared, where the predictive residual signal calculated by the inverse filter is stored in the buffer memory temporarily, the waveform synthesizing section outputs the synthesized prediction residual signal into the synthesis filter, the linear predictive coefficientss interpolating section interpolates the linear predictive coefficientss to make it the most appropriate coefficient for the synthesized predictive residual signal and the synthesis filter outputs an output voice signal using the interpolated linear predictive coefficientss.

Accordingly, an output voice signal is synthesized using the linear predictive coefficientss interpolated to make it the most appropriate coefficient for the synthesized predictive residual signal, which improves the voice quality.

BEST MODE FOR CARRYING OUT THE INVENTION

The embodiments of the present invention are explained concretely with reference to drawings.

(First embodiment)

Figure 1:
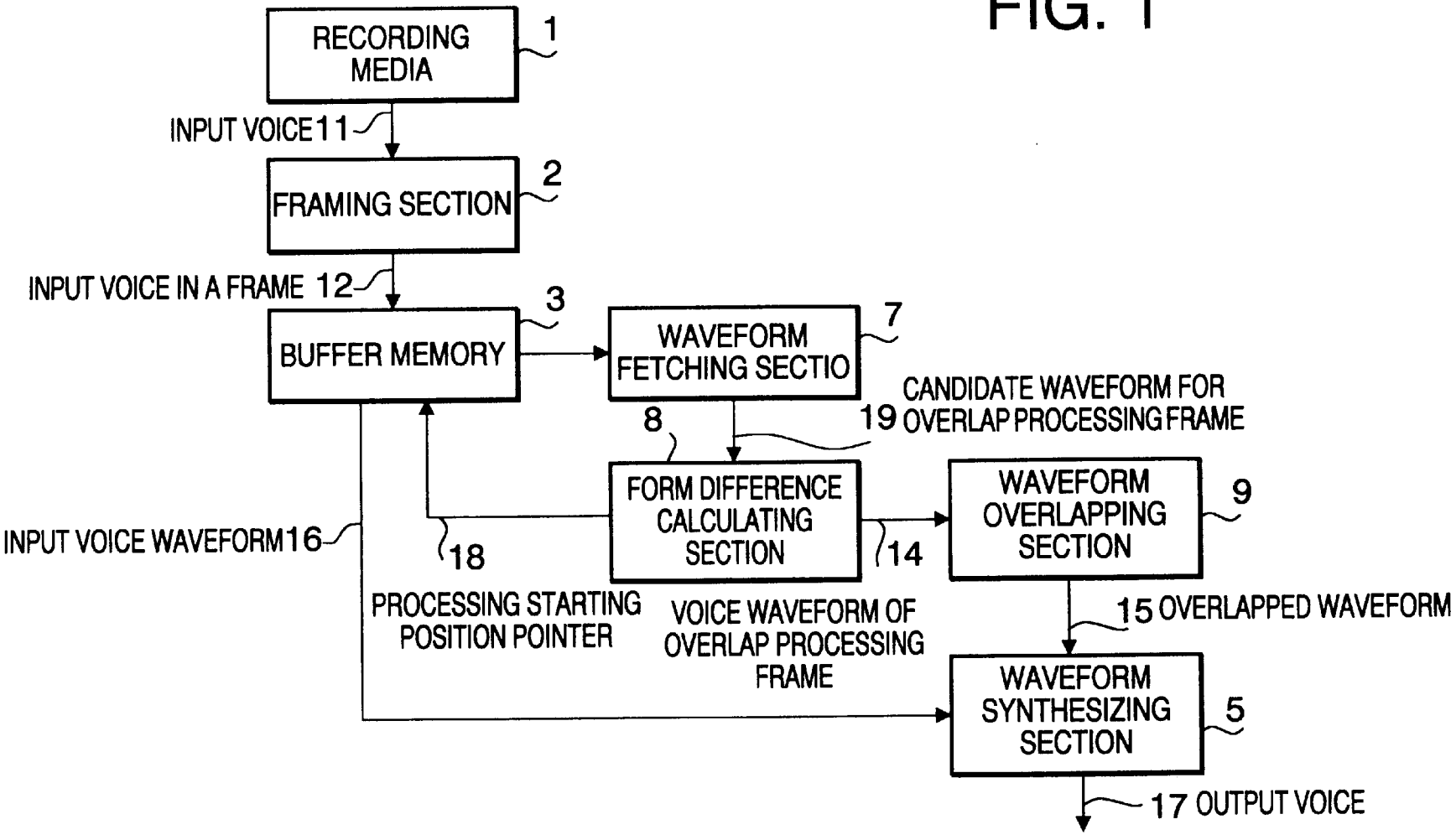
FIG. 1 is a block diagram of an apparatus for converting a voice reproducing rate in the first embodiment of the present invention.

FIG. 1 illustrates function blocks of an apparatus for converting a voice reproducing rate in the first embodiment of the present invention. In addition, the sections in FIG. 1 having the same function as that of each section of the apparatus illustrated in FIG. 9 mentioned previously have the same marks as those.

In this apparatus for converting a voice reproducing rate, waveform fetching section 7 provides a starting position and a length of a waveform to fetch into buffer memory 3 and fetches (a plurality of) neighboring two voice waveforms of the same length from buffer memory 3. Form difference calculating section 8 calculates a form difference between two voice waveforms fetched by waveform fetching section 7, select two waveforms of the length where the form difference is the minimum, and determines frames for overlap processing. Then, waveform overlapping section 9 overlaps two waveforms determined at form difference calculating section 8.

Figure 9:
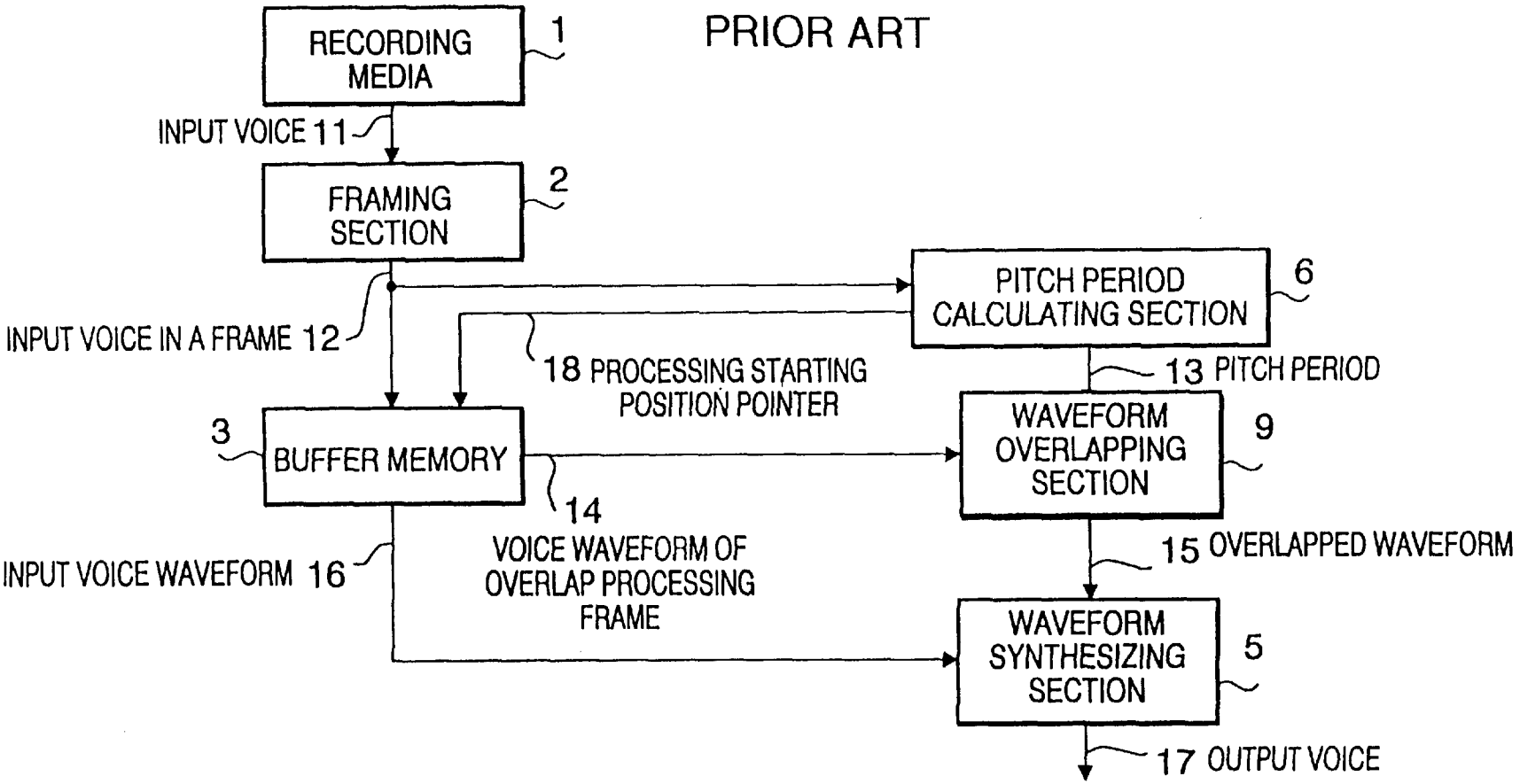
FIG. 9 PRIOR ART
FIG. 9 is a block diagram of a conventional apparatus for converting a voice reproducing rate.
Figure 10:
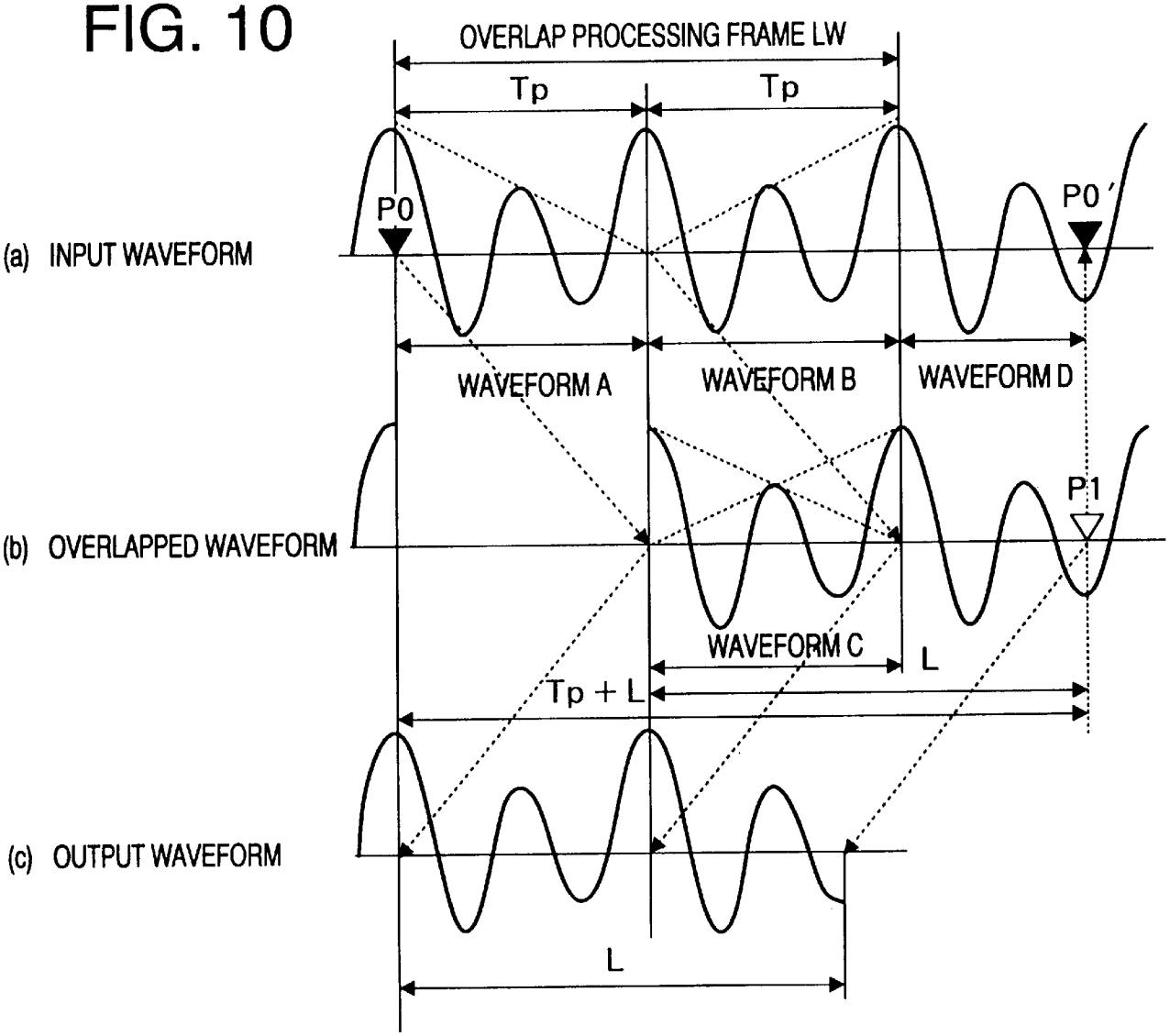
FIG. 10 is a diagram illustrating the relation of an input waveform, a overlapped waveform and an output waveform in the case of high rate reproducing.
Figure 11:
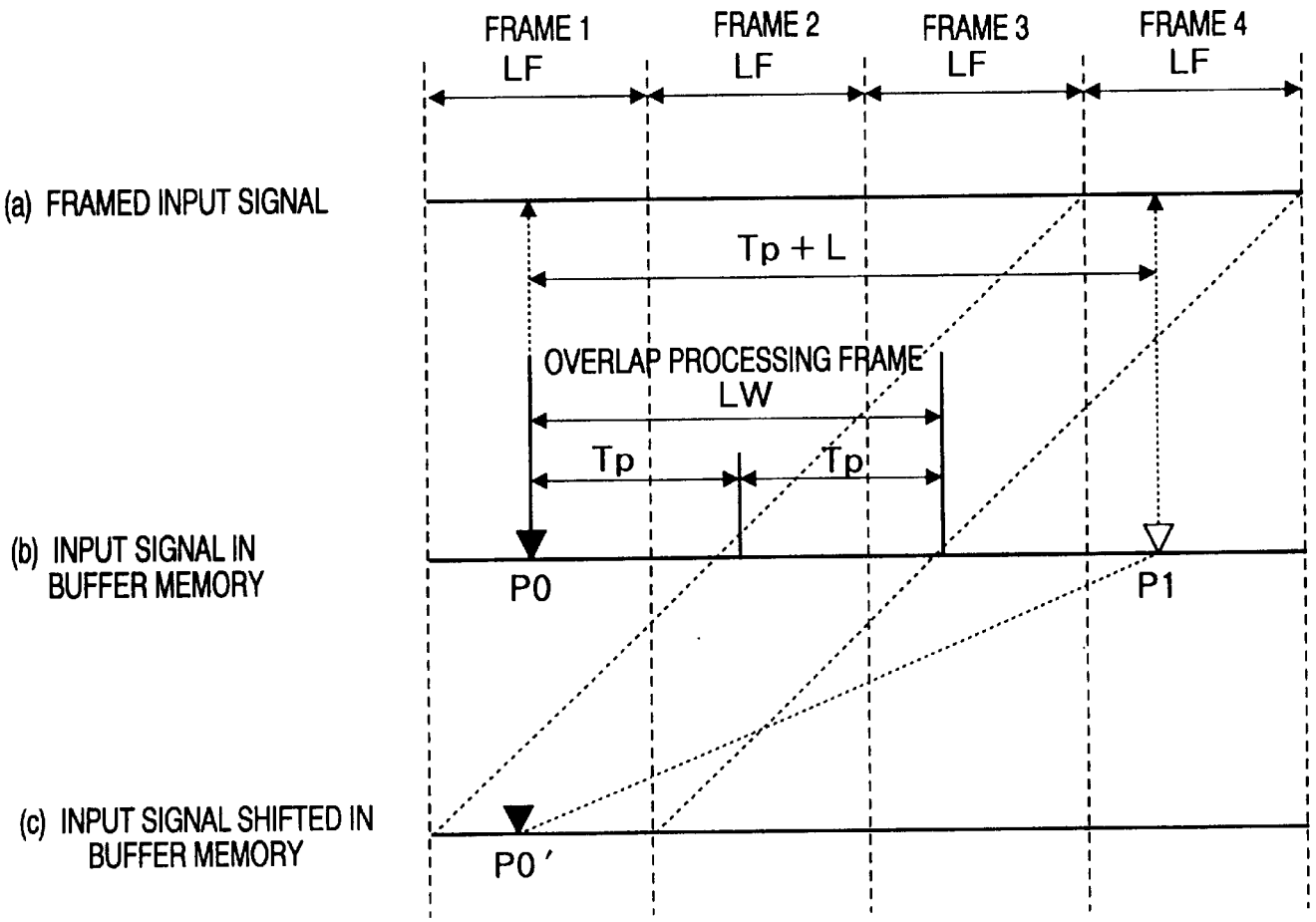
FIG. 11 is a diagram illustrating the relation of a framed input signal, an input signal in a buffer memory and a shifted input signal in a buffer memory.
Figure 12:
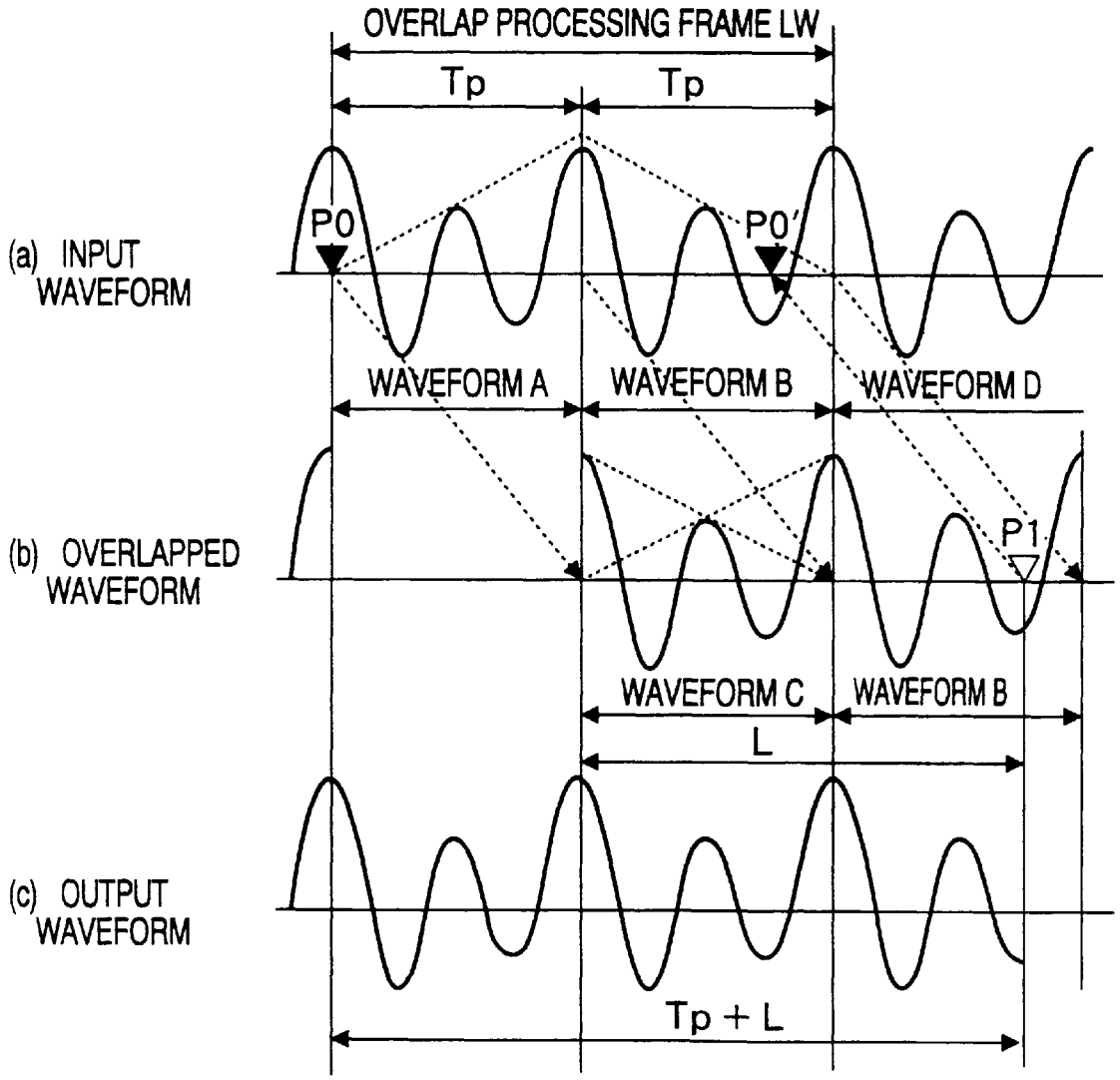
FIG. 12 is a diagram illustrating the relation of an input waveform, a overlapped waveform and an output waveform in the case of low rate reproducing.

In addition, in the same way as the apparatus illustrated in FIG. 9 described previously, digitized voice signals are recorded in recording media 1, framing section 2 fetches a voice signal in a frame of a predetermined length LF sample from recording media 1 and the voice signal fetched by framing section 2 is stored in buffer memory 3 temporarily. And, waveform synthesizing section 5 synthesizes an output voice signal waveform from the voice signal waveform stored in buffer memory 3 and the overlapped waveform processed at waveform overlapping section 9.

The functions of recording media 1, framing section 2, buffer memory 3, waveform overlapping section 9 and waveform synthesizing section 5 in this apparatus and the processing for converting a reproducing rate are the same as those of a conventional apparatus. Therefore, the explanation for those are omitted and the functions of waveform fetching section 7 and form difference calculating section 8, and the process for determining a overlap processing frame are primarily explained.

Figure 2:
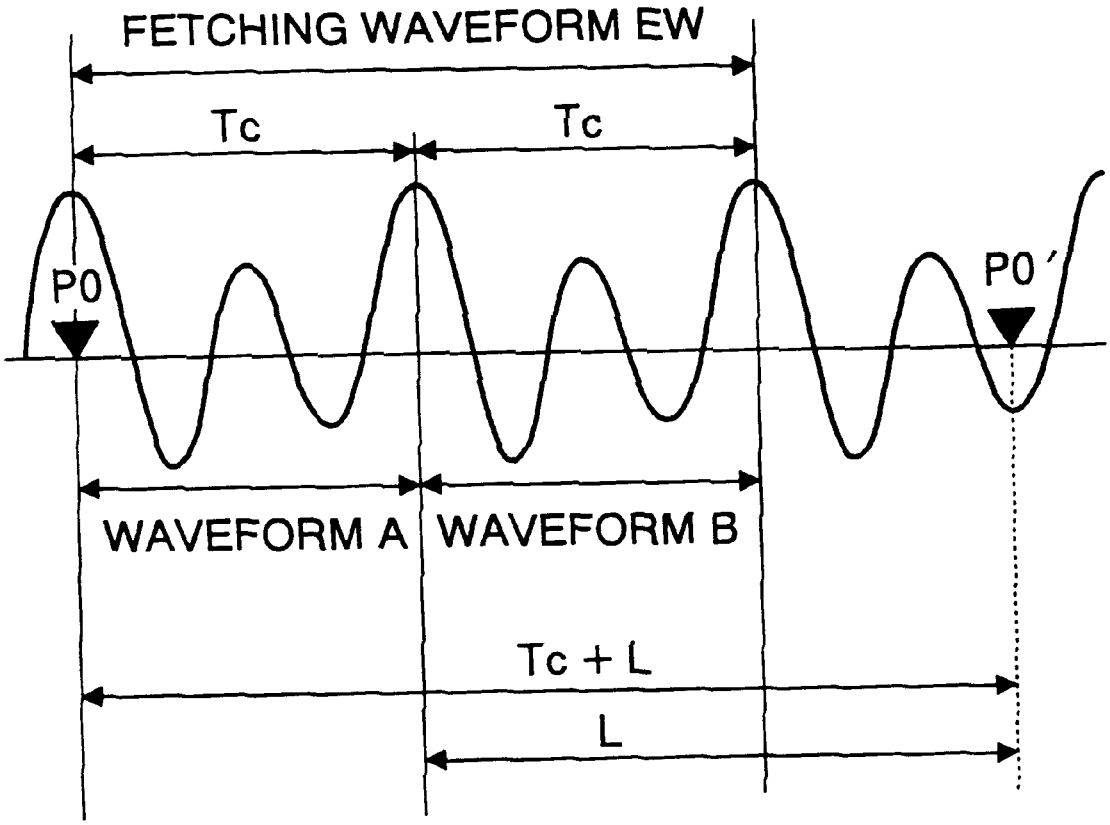
FIG. 2 is a diagram of a waveform of the object for converting a reproducing rate in the first embodiment of the present invention.

Waveform fetching section 7, as illustrated in FIG. 2, fetches neighboring two waveforms of the same length Tc (waveform A and waveform B) from pointer P0 of a processing starting position from buffer memory 3 as a candidate waveform 19 for an overlap processing frame.

Form difference calculating section 8 calculates a form difference between two waveforms of waveform A and waveform B. The form difference between two waveforms Err is shown as the following formulation where waveform A is x(n), waveform B is y(n) and n is a sample postion.

$$Err=\Sigma\{x(n)-y(n)\}^2 \tag{3}$$

(Summation is from n=0 to n=Tc−1)

Form difference calculating section 8 fetches other neighboring two waveforms of waveforms A and B of different length (the number of samples) from pointer P0 fixed as a processing starting position from buffer memory 3 and calculates form difference Err between two waveforms.

A plurality of form differences Err are calculated by taking two waveforms A and B of different length (the number of samples) sequentially. And the combination of waveform A and B having the minimum form difference Err is selected.

In this case, since Err is a summation difference of samples at a waveform length Tc, it is impossible to directly compare the differences of waveforms of different Tc lengths. Therefore, for instance, using the value of Err divided by the number of samples in Tc, that is, an average difference Err/Tc for a sample, it is possible to compare the differences. The range of sampling numbers in a waveform length Tc is predetermined, for instance, for voice signals of 8 kHz sampling, 16 through 160 samples may be appropriate. By varying a waveform length Tc within the predetermined range, calculating the average difference Err/Tc for each Tc and comparing them, Tc of the minimum average difference is determined as the length of waveform to obtain.

Waveform overlapping section 9 fetches two waveforms A and B selected from form difference calculating section 8 as a overlap processing frame 14, processes a processing frame (waveform A) and another processing frame (waveform B) separately according to the different triangle window functions then generates overlapped waveform 15 by overlapping both waveforms.

Waveform synthesizing section 5 fetches input voice waveform 16 from buffer memory 3, and replaces a part of input voice waveform 16 with overlapped waveform 15 or inserts the overlapped waveform 15 into the input voice waveform 16 on the basis of the reproducing rate r to generates output voice 17 rate-converted.

According to the embodiment of the present invention, since waveform fetching section 7 fetches a pair of neighboring waveforms A and B as a candidate for waveform to synthesize from buffer memory 3, gradually varies a length of waveform to fetch, calculates Err/Tc that is a form difference between waveforms in each waveform pair and selects the pair of waveforms A and B of the minimum form difference Err/Tc to synthesize, the distortion caused by overlapping waveforms A and B is decreased, which allows to improve the quality of output voice.

(Second embodiment)

The second embodiment illustrates the case where conversion of reproducing rate is processed with the residual signal representing a pitch waveform remarkably.

Figure 3:
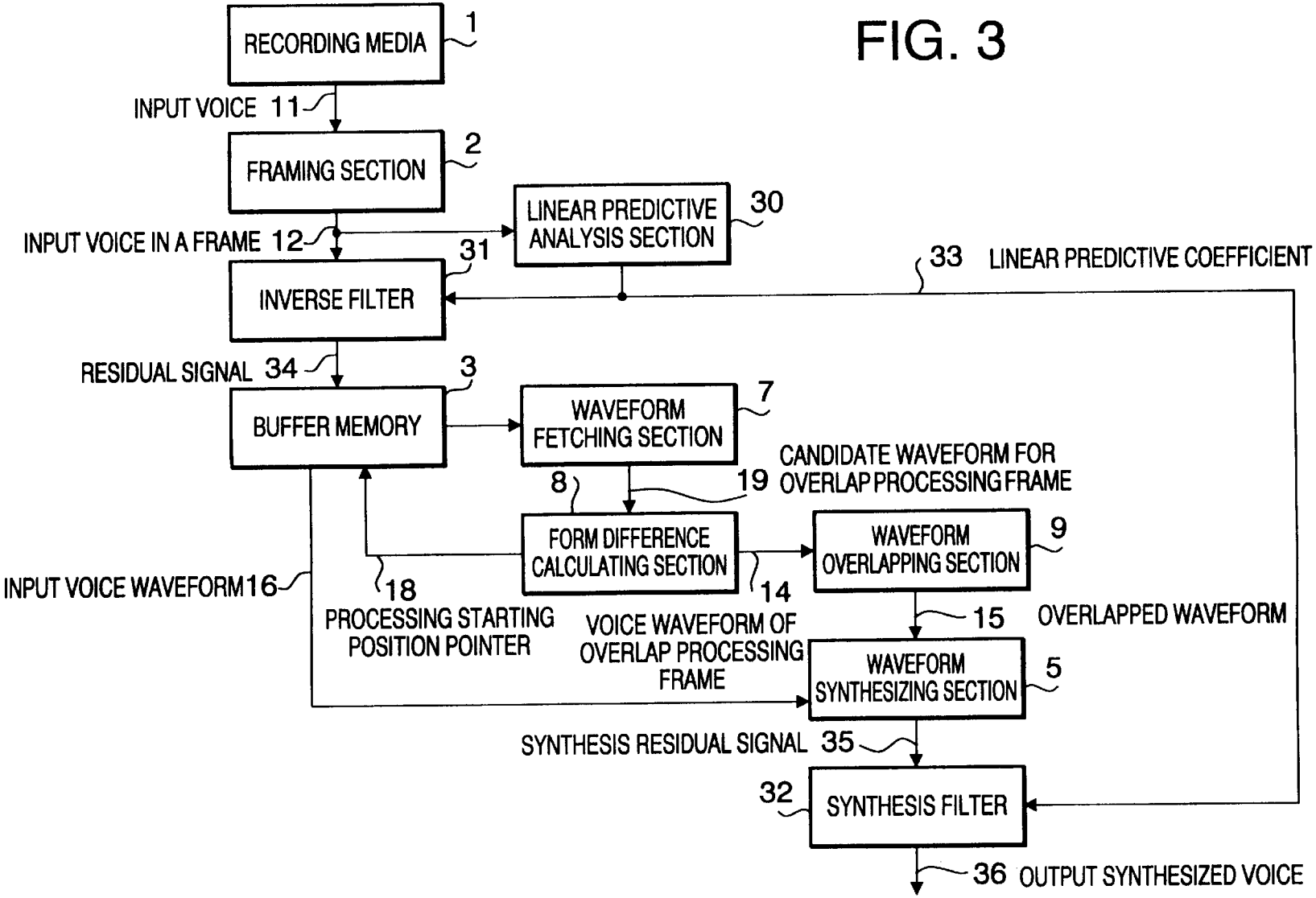
FIG. 3 is a block diagram of an apparatus for converting a voice reproducing rate in the second embodiment of the present invention.

FIG. 3 illustrates function blocks of an apparatus for converting a voice reproducing rate in the second embodiment of the present invention. In addition, the sections in FIG. 3 having the same function as that of each section of the apparatus illustrated in FIG. 1 and FIG. 9 mentioned previously have the same marks as those.

This apparatus for converting a voice reproducing rate comprises linear predictive analysis section 30 to calculate the linear predictive coefficientss representing spectrum information of input voice signals, inverse filter 31 to calculate the prediction residual signal with the calculated linear predictive coefficientss from input voice signals and synthesis filter 32 to synthesize voice signals with the linear predictive coefficientss from the prediction residual signal. The other configuration at the apparatus for converting a voice reproducing rate in the embodiment of the present invention is the same as that of the first embodiment of the present invention.

In the apparatus for converting a voice reproducing rate constituted as described above, input voice in a frame 12 fetched at framing section 2 is input into linear predictive analysis section 30 and inverse filter 31. Linear predictive coefficientss 33 is calculated from input voice 12 in a frame at linear predictive analysis section 30 and residual signal 34 is calculated from input voice 12 with linear predictive coefficientss 33 at inverse filter 31.

The residual signal 34 calculated at inverse filter 31 is waveform-synthesized at buffer memory 3, waveform fetching section 7, form difference calculating section 8 and waveform overlapping section 9 according to the processing of converting a voice reproducing rate explained in the first embodiment of the present invention, and is output as synthesis residual signal 35 from waveform synthesis section 5.

Synthesis filter 32 calculates output synthesized voice 36 from synthesis residual signal 35 with linear predictive coefficients 33 provided from linear predictive analysis section 30 to output.

In the embodiment of the present invention as described above, two waveforms are fetched and waveform-synthesized from the predictive residual signal that is an input voice signal in which spectrum envelop information represented by linear predictive coefficients is removed. Since the predictive residual signal represents a pitch waveform more remarkably than the original input signal, by processing conversion of voice reproducing rate with the residual signal as described in the embodiment of the present invention, a pitch waveform can be fetched exactly and the quality of reproduced voice can be improved.

(Third embodiment)

In the third embodiment, computational complexity is reduced by combining an apparatus for converting a voice reproducing rate with a voice coding apparatus and using voice coding information provided from the voice coding apparatus at the rate conversion processing.

Figure 4:
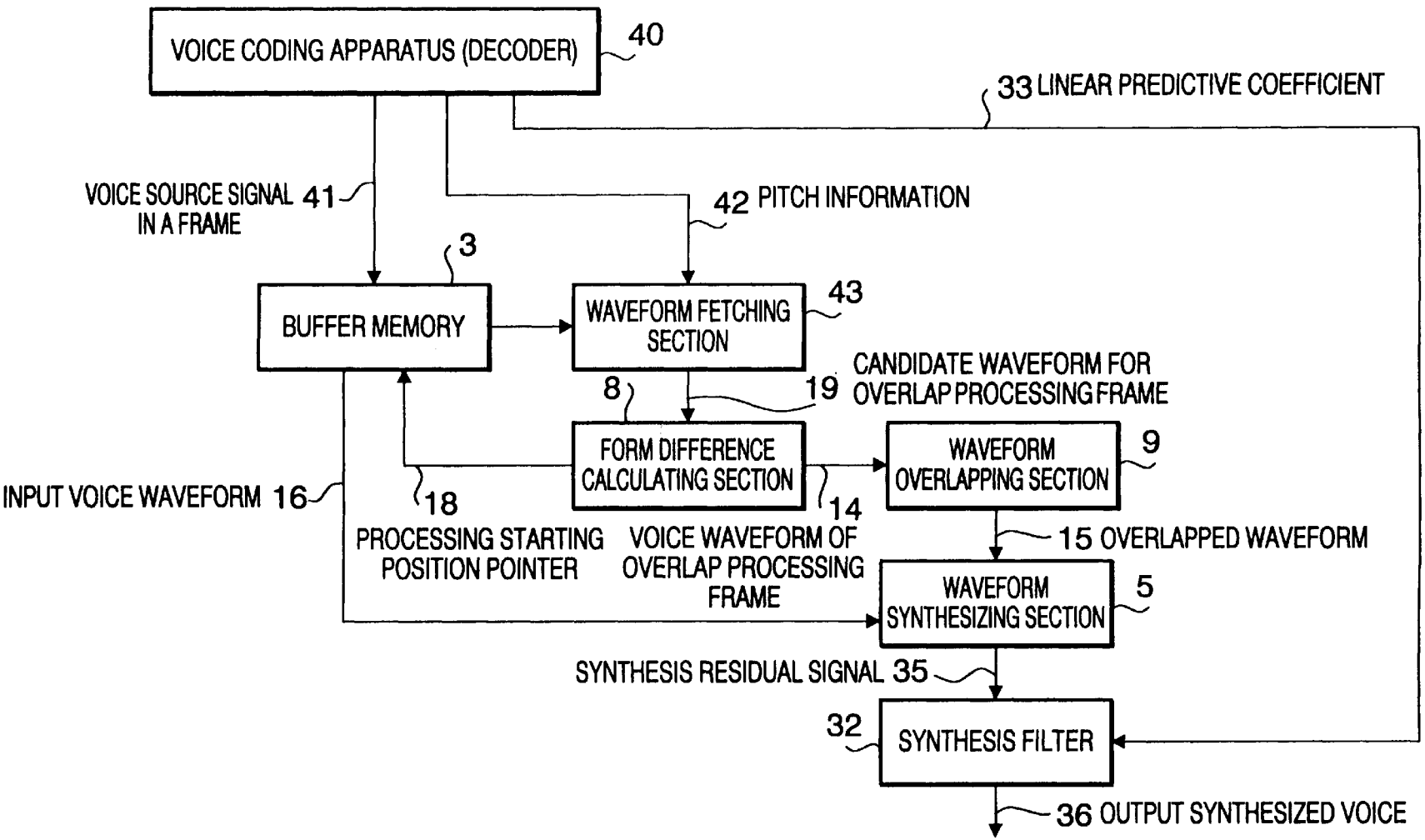
FIG. 4 is a block diagram of an apparatus for converting a voice reproducing rate in the third embodiment of the present invention.

FIG. 4 illustrates function blocks of an apparatus for converting a voice reproducing rate in the embodiment of the present invention. In addition, the sections in FIG. 4 having the same function as that of each section of the apparatus illustrated in FIG. 1, FIG. 3 and FIG. 9 mentioned previously have the same marks as those.

In this apparatus for converting a voice reproducing rate, recording media 1, framing section 2, linear predictive analysis section 30 and inverse filter 31 in the second embodiment of the present invention are replaced with decoder of a voice coding apparatus 40 comprising the sections described above. Decoder of voice coding apparatus 40 has the function of coding voice signal by dividing them into linear predictive coefficients representing spectrum information, pitch period information and voice source information representing predictive residual. As a voice coding apparatus described above, CELP (Code Excited Linear Predictive coding) is primarily known. And, generally, in a high efficient voice coding apparatus like CELP, each coding information is coded in a frame. Accordingly, since voice source signal 41 output from decoder 40 is a signal in a frame of a length predetermined by the voice coding apparatus, it can be used directly as an input for the apparatus for converting a voice reproducing rate of the present invention.

In the apparatus for converting a voice reproducing rate in this embodiment of the present invention, voice source signal in a frame 41 output from decoder 40 is stored in buffer memory 3, pitch period information 42 is input into waveform fetching section 43 and linear predictive coefficients 33 is input into synthesis filter 32.

Waveform fetching section 43 fetches neighboring waveforms A and B of length Tc from buffer memory 3 and provides a plurality of pairs of waveforms A and B of a different length into form difference calculating section 8 sequentially. And, since the range of length Tc of waveforms fetched is varied according to pitch period information 42 at waveform fetching section 43, the computational complexity to calculate differences can be decreased largely. And, linear predictive coefficients 33 output from the decoder is used as an input for synthesis filter 32.

In this way, by combining a decoder of voice coding apparatus for coding voice signals by dividing them into a linear predictive coefficients representing spectrum information, pitch period information and voice source information representing prediction residual and an apparatus for converting a reproducing rate of the present invention, it is possible to use information output from the voice coding apparatus and convert a reproducing rate of voice signals coded at the voice coding apparatus with less computational complexity.

(Fourth embodiment)

In an apparatus for converting a voice reproducing rate in the fourth embodiment of the present invention, computational complexity is reduced by combining it with a voice coding apparatus and using voice coding information provided from the voice coding apparatus.

Figure 5:
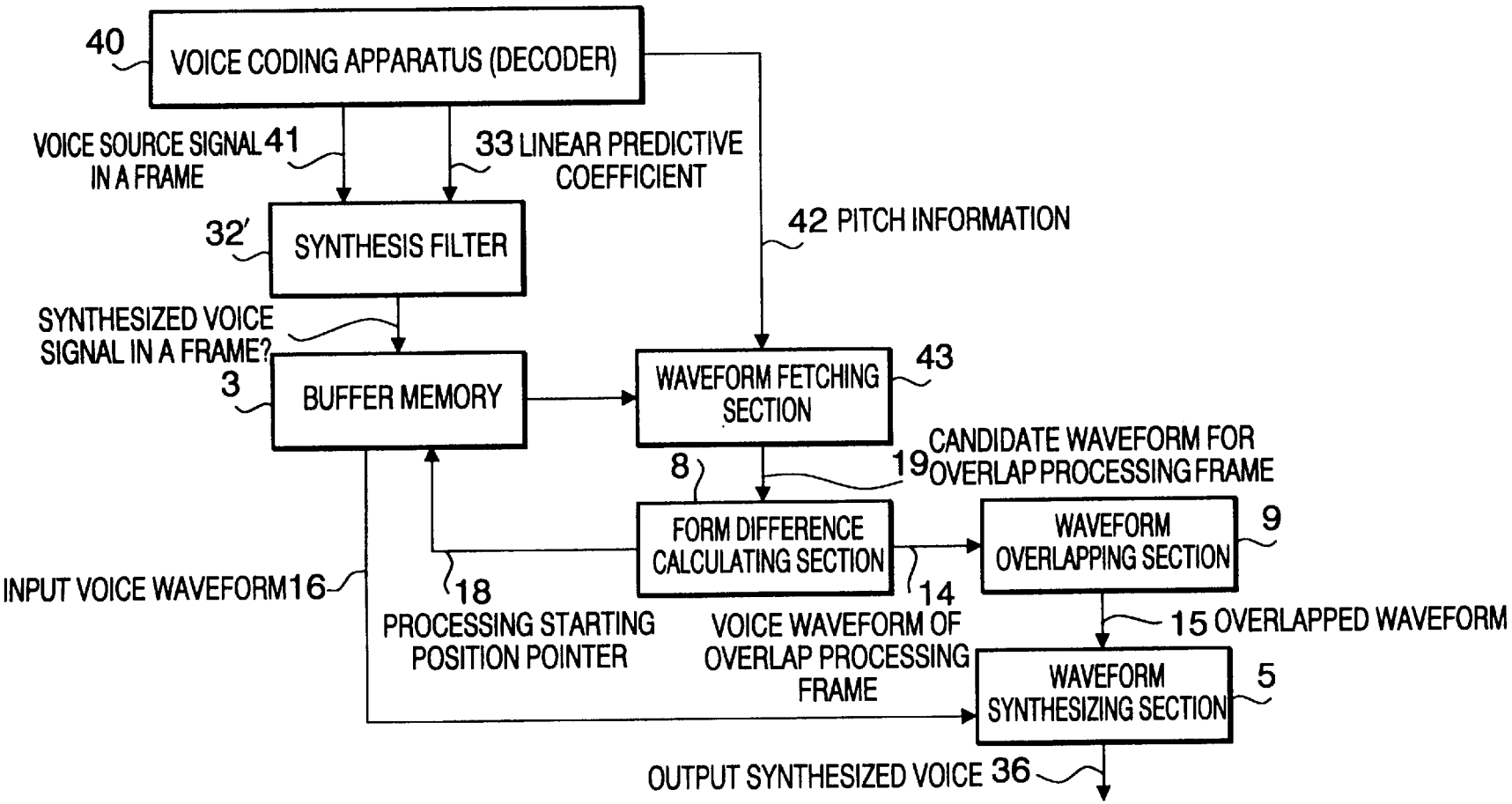
FIG. 5 is a block diagram of an apparatus for converting a voice reproducing rate in the fourth embodiment of the present invention.

FIG. 5 illustrates function blocks of an apparatus for converting a voice reproducing rate in the embodiment of the present invention. In addition, the sections in FIG. 5 having the same function as that of the third embodiment of the present invention mentioned previously have the same marks as those.

In the apparatus for converting a voice reproducing rate, synthesis filter 32' having the same function as that of synthesis filter 32 comprised in the third embodiment of the present invention is prepared between decoder of a voice coding apparatus 40 and buffer memory 3. Synthesis filter 32' generates a decoded voice signal from voice source signal 41 in a frame and linear predictive coefficients 33 and stores it as synthesis voice signal 44 in buffer memory. Since voice source signal 41 is input from decoder 40 in a frame, synthesis voice signal 44 is also a signal in a frame. Accordingly, it is available to directly use as an input of the apparatus for converting a voice reproducing rate of the present invention.

As described above, by combining a voice coding apparatus 40 for coding voice signals by dividing them into linear predictive coefficients representing spectrum information, pitch period information and voice source information representing prediction residual and an apparatus for converting a reproducing rate of the present invention, it is possible to use information output from the voice coding apparatus and convert a reproducing rate of voice signals coded at the voice coding apparatus with less computational complexity.

(Fifth embodiment)

In an apparatus for converting a voice reproducing rate in the fifth embodiment of the present invention, by interpolating the linear predictive coefficients to make it the most appropriate coefficient for the synthesized residual signal, the voice quality can be improved.

Figure 6:
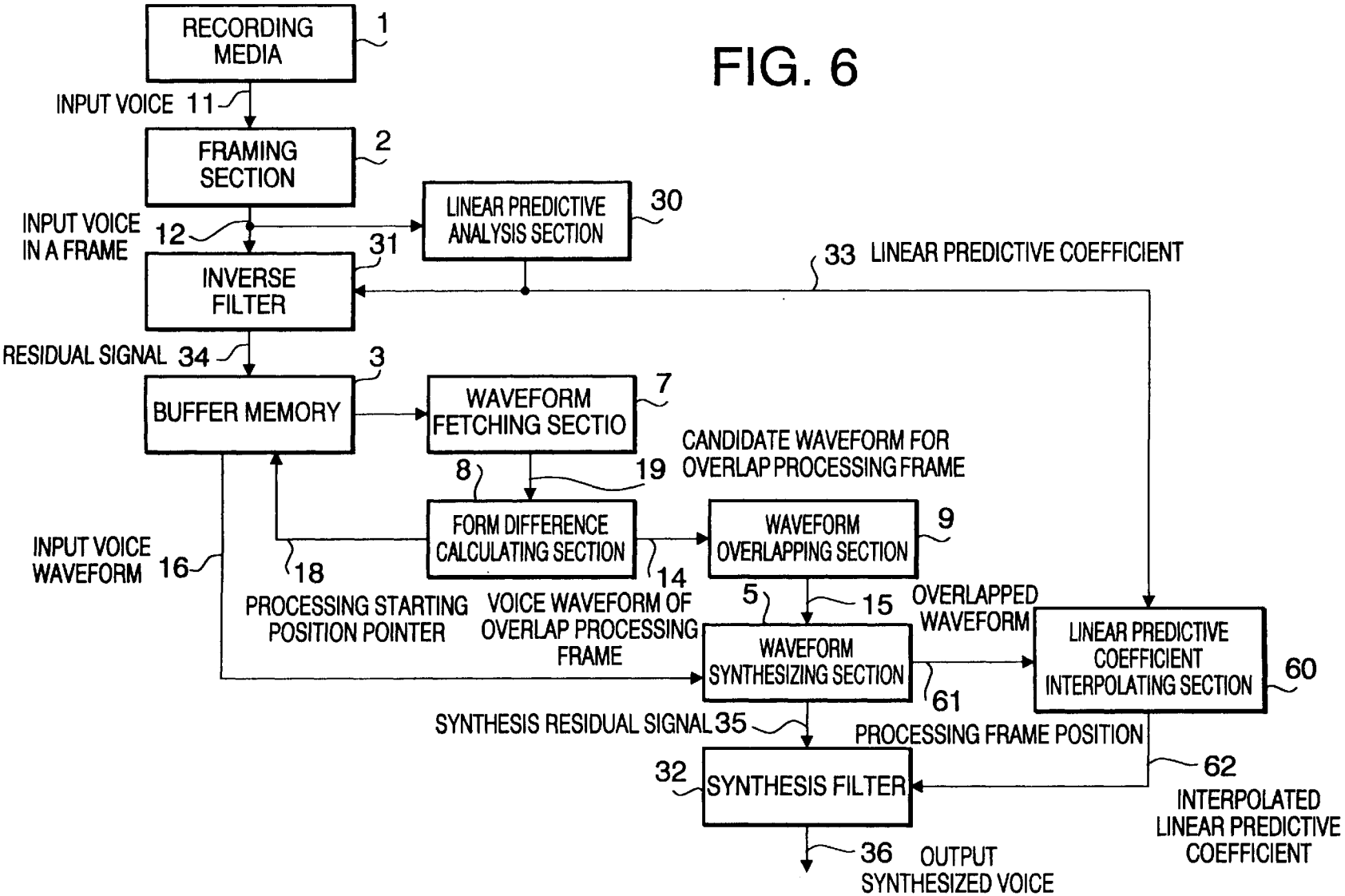
FIG. 6 is a block diagram of an apparatus for converting a voice reproducing rate in the fifth embodiment of the present invention.

FIG. 6 illustrates function blocks of an apparatus for converting a voice reproducing rate in the embodiment of the present invention. In addition, the sections in FIG. 6 having the same function as that of the each embodiment of the present invention mentioned previously have the same marks as those.

This apparatus for converting a voice reproducing rate comprises linear predictive analysis section 30 to calculate the linear predictive coefficients representing spectrum information of input voice signals, inverse filter 31 to calculate the predictive residual signal 34 with the calculated linear predictive coefficients 33 from input voice signals and synthesis filter 32 to synthesize voice signals with the linear predictive coefficients from input voice signals and linear predictive coefficients interpolation section 60 to interpolate linear predictive coefficients 33 to make it the most appropriate coefficient for the synthesized residual signal. The other configuration at the apparatus is the same as that of the first embodiment of the present invention (FIG. 1).

In this apparatus for converting a voice reproducing rate constituted as described above, input voice in a frame 12 fetched from recording media at framing section 2 is input into linear predictive analysis section 30. Linear predictive analysis section 30 calculates linear predictive coefficients 33 from input voice in a frame 12 to input inverse filter 31 and linear predictive coefficients interpolation section 60. Inverse filter 31 calculates residual signal 34 from input voice 12 with linear predictive coefficients 33. This residual signal 34 is waveform-synthesized by the processing of converting a voice reproducing rate explained in the first embodiment of the present invention, and is output as synthesis residual signal 35 from waveform synthesis section 5.

Linear predictive coefficients interpolation section 60 receives processing frame position information 61 from waveform synthesizing section 4 and interpolates linear predictive coefficients 33 to make it the most appropriate coefficient for synthesis residual signal 35. Interpolated linear predictive coefficients 62 is input into synthesis filter 32, and output voice signal 36 is synthesized from synthesis residual signal 35.

Figure 7:
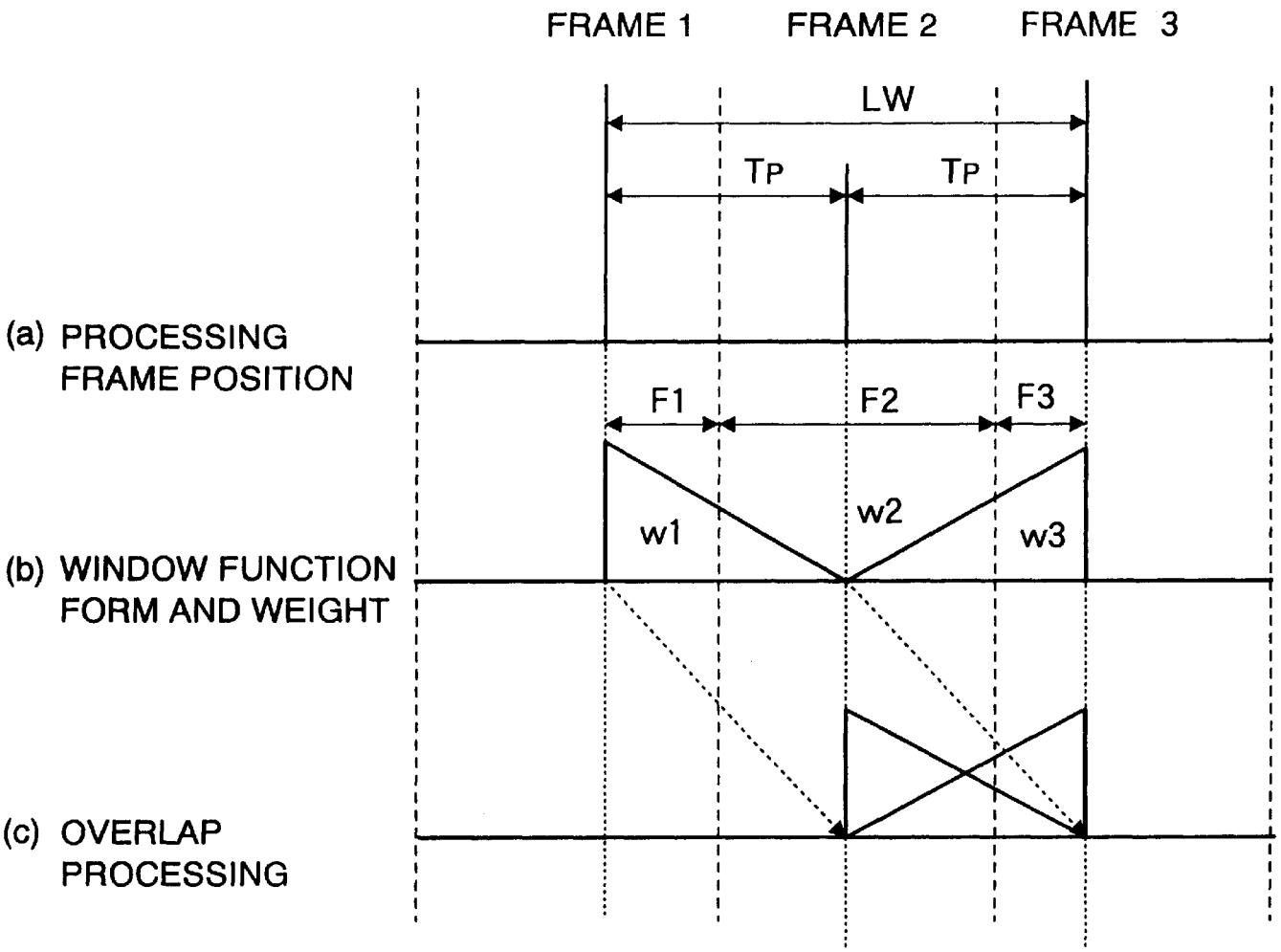
FIG. 7 is a diagram illustrating the relation of a position of processing frame, a function form and weight, and overlap processing.

An example to interpolate linear predictive coefficients 33 to make it the most appropriate coefficient for synthesis residual signal 35 is explained with reference to FIG. 7.

As illustrated in FIG. 7A, a processing frame to calculate synthesis residual signal 35 is assumed to cross over input frames 1, 2 and 3. The form of window function to use for overlapping waveforms is assumed to have the form and weight as illustrated in FIG. 7B. Accordingly, as illustrated in FIG. 7C, the data amount included in the overlapped waveform generated by overlap processing is the data amount in included in intervals F1, F2 and F3 weighted by w1, w2 and w3 by considering the window function form. By making the original data amount included in this overlapped waveform a basis, interpolated linear predictive coefficients 62 is obtained according to the following formulation.

$$\begin{aligned}&\text{(Interpolated linear predictive coefficients)} = \\ &\quad \text{(linear predictive coefficients of frame 1)} \times \text{(weight } w1\text{)} + \\ &\quad \text{(linear predictive coefficients of frame 1)} \times \text{(weight } w2\text{)} + \\ &\quad\quad \text{(linear predictive coefficients of frame 1)} \times \text{(weight } w3\text{)}\end{aligned}$$

Where, w1+w2+w3=1.

In addition, concerning weight w1, w2 and w3, the factors to consider are not only the window function form but also the similarity of linear predictive coefficientss each of frames 1, 2 and 3, and others. And as an interpolated linear predictive coefficients to calculate, not only one coefficient but also a plurality of coefficients are available, which are obtained by dividing the overlapped waveform into a plurality of parts and calculating the most appropriate interpolated linear predictive coefficients for each part. And, in the processing of interpolating the linear predictive coefficients, the performance can be improved by converting each linear predictive coefficients into LSP parameter, etc. appropriate for the interpolation processing, interpolation processing the converted LSP parameter, etc. and reconverting the calculated result into the linear predictive coefficients.

(Sixth embodiment)

In an apparatus for converting a voice reproducing rate in the sixth embodiment of the present invention, the amount for calculating is reduced by combining it with a voice coding apparatus and using voice coding information provided from the voice coding apparatus.

Figure 8:
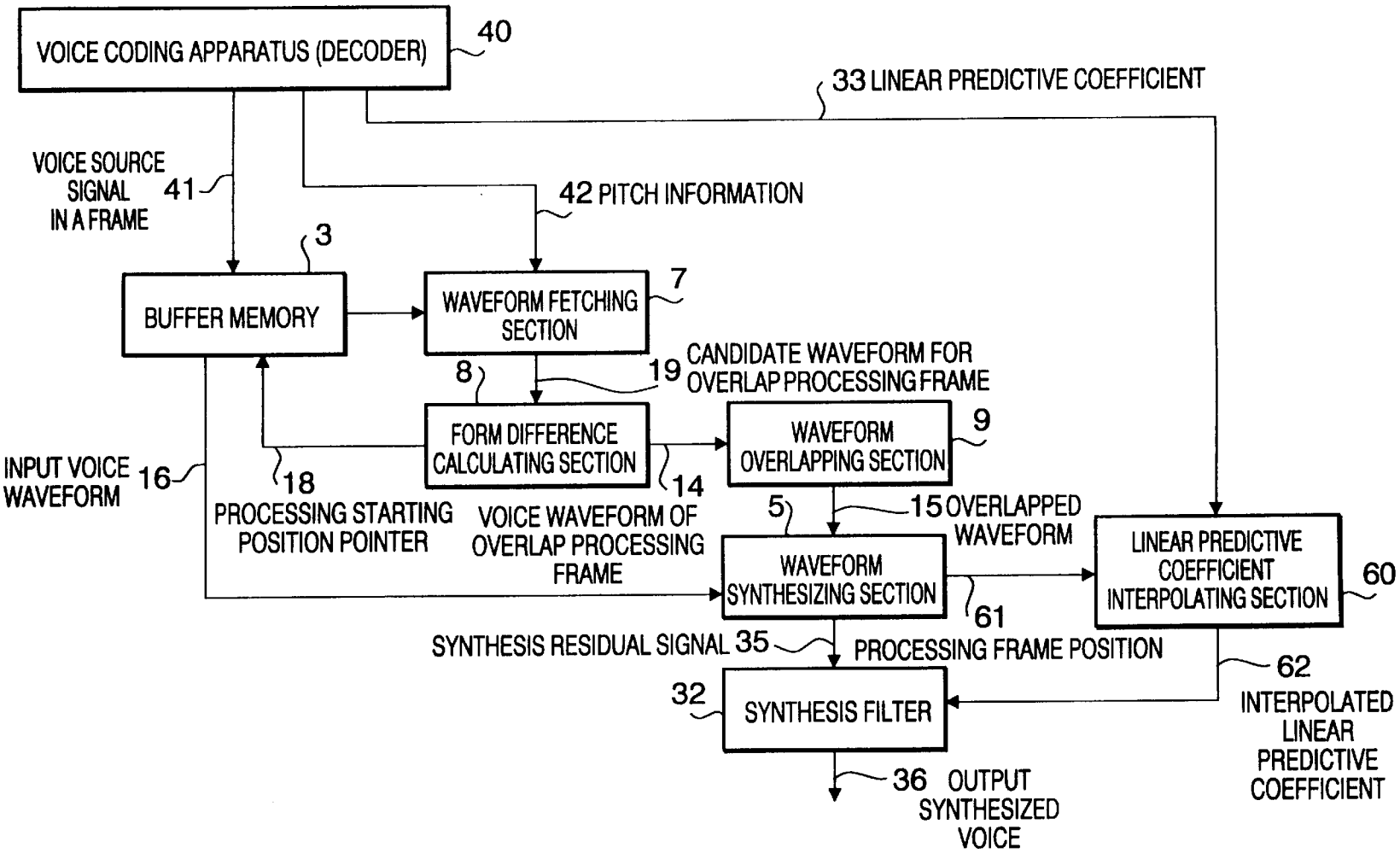
FIG. 8 is a block diagram of an apparatus for converting a voice reproducing rate in the sixth embodiment of the present invention.

FIG. 8 illustrates function blocks of an apparatus for converting a voice reproducing rate in the embodiment of the present invention.

In this apparatus for converting a voice reproducing rate, a voice coding apparatus(decoder 40), which is used in the third embodiment, for coding voice signals by dividing them into linear predictive coefficients representing spectrum information, pitch period information and voice source information representing prediction residual is prepared by replacing with recording media 1 and framing section 2 in the fifth embodiment of the present invention.

Voice source signal in a frame 41 output from decoder 40 is input into buffer memory 3 and linear predictive coefficients 33 is input into linear predictive coefficients interpolating section 60. And, pitch period information 42 is input into waveform fetching section 43 and the range of length Tc of a waveform to fetch at waveform fetching section 43 is switched corresponding to pitch period information 42. According to it, since the range of length Tc of a waveform to fetch is restricted, computational complexity to obtain a difference can be reduced largely.

According to the embodiment of the present invention as described above, by combining a voice coding apparatus 40 for coding voice signals by dividing them into linear predictive coefficients representing spectrum information, pitch period information and voice source information representing prediction residual and an apparatus for converting a reproducing rate of the present invention, it is possible to use information output from the voice coding apparatus and convert a reproducing rate of voice signals coded at the voice coding apparatus with less computational complexity.

(Seventh embodiment)

An apparatus for converting a voice reproducing rate of the present invention is achieved by using software in which the algorithm of the processing is described in a programming language. By recording the program in a recording media such as a floppy Disk (FD), etc., connecting the recording media to a general-purpose signal processing apparatus such as personal computer, etc. and executing the program, the function of the apparatus for converting a voice reproducing rate of the present invention is achieved.

The present invention is not limited by the embodiments described above, but can be applied for a modified embodiment within the scope of the present invention.

Industrial Applicability

As described above, an apparatus for converting a voice reproducing rate of the present invention is useful to reproduce a voice signal recorded in a recording media at an arbitrary rate without transforming the pitch of voice and appropriate for improving the quality of output voice.

We claim:

1. An apparatus for converting a voice reproducing rate comprising:

waveform selecting means for selecting neighboring two voice waveforms having the same length and the minimum form difference from voice waveforms of an input voice signal;

waveform overlapping means for overlapping said two voice waveforms selected at said waveform selecting means; and waveform synthesizing means for generating an output voice waveform rate-converted by replacing a part of said voice waveform of said input voice with the overlapped voice waveforms or inserting the overlapped voice waveforms into said voice waveforms of said input voice.

2. The apparatus for converting a voice reproducing rate according to claim 1, wherein said selecting means including:

fetching means for fetching a plurality of pairs of neighboring two voice waveforms having the same length from a buffer memory in which voice waveform data of said input voice signal are stored, wherein a length of each pair of two waveforms is made different; and means for detecting a pair of voice waveforms having the minimum form difference from a plurality of the pairs of the voice waveforms fetched by said fetching means from said buffer memory.

3. The apparatus for converting a voice reproducing rate according to claim 1, wherein said waveform selecting means uses waveform data of a prediction residual signal representing a pitch waveform remarkably as voice waveform data of said input voice signal.

4. The apparatus for converting a voice reproducing rate according to claim 3, wherein said apparatus comprising:

linear predictive analysis means for calculating a linear predictive coefficients representing spectrum information of said input voice signal;

inverse filter for calculating said prediction residual signal from said input voice signal using the calculated linear predictive coefficients; and synthesis filter for synthesizing a voice signal from a synthesis residual signal output from said waveform synthesis means using said linear predictive coefficients.

5. The apparatus for converting a voice reproducing rate according to claim 4, said apparatus further comprising: linear predictive coefficients interpolating means for interpolating said linear predictive coefficients calculated at said linear predictive analysis means to make it the most appropriate coefficient for said synthesis residual signal; and wherein said synthesis filter synthesizes an output voice signal using the interpolated linear predictive coefficients.

6. The apparatus for converting a voice reproducing rate according to claim 1, wherein said apparatus executes rate conversion processing using output information of a voice coding apparatus for coding a voice signal by dividing it into a linear predictive coefficients representing spectrum information, pitch period information and voice source information representing a predictive residual.

7. The apparatus for converting a voice reproducing rate according to claim 6, wherein said waveform selecting means comprising:

fetching means for fetching a plurality of pairs of neighboring two voice waveforms having the same length from a buffer memory in which said input voice source information is stored, wherein a length of each pair of two voice waveforms is made different, and setting a range of a length of a waveform to fetch on the basis of said pitch period information; and means for detecting a pair of voice waveforms in which a form difference between two waveforms is the minimum from a plurality of the pairs of the voice waveforms fetched by said fetching means from said buffer memory.

8. The apparatus for converting a voice reproducing rate according to claim 7, said apparatus comprising:

synthesis filter for synthesizing a voice signal from a synthesis residual signal using said linear predictive coefficients; and wherein said synthesis residual signal is input into said synthesis filter from said waveform synthesis means.

9. The apparatus for converting a voice reproducing rate according to claim 8, said apparatus comprising:

linear predictive coefficients interpolating means for interpolating said linear predictive coefficients included in the output information of said voice coding apparatus to make it the most appropriate coefficient for said synthesis residual signal; and wherein said synthesis filter synthesizes output voice signal using the interpolated linear predictive coefficients.

10. The apparatus for converting a voice reproducing rate according to claim 6, said apparatus comprising:

synthesis filter for synthesizing a synthesis voice signal from voice source information included in said output information of said voice coding apparatus using the linear predictive coefficients included in said output information of said voice coding apparatus; and wherein said synthesis voice signal is provided into said waveform selecting means.

11. The apparatus for converting a voice reproducing rate according to claim 10, wherein said waveform selecting section comprising:

fetching means for fetching a plurality of pairs of neighboring two voice waveforms of the same length from a buffer memory in which voice waveform data of said input voice signal are stored, wherein a length of each pair of two waveforms is made different, and setting the range of length of a waveform to fetch on the basis of said pitch period information; and means for detecting a pair of voice waveforms in which a form difference between two waveforms is the minimum from a plurality of the pairs of the voice waveforms fetched by said fetching means from said buffer memory.

12. A method for converting a voice reproducing rate comprising the steps of:

selecting neighboring two voice waveforms having the same length and the minimum form difference from voice waveforms of an input voice signal;

overlapping said selected two voice waveforms; and generating an output voice waveform rate-converted by replacing a part of said voice waveform of said input voice with the overlapped voice waveforms or inserting the said overlapped voice waveform to the said voice waveform of said input voice.

13. The method for converting a voice reproducing rate according to claim 12, wherein said method for converting a voice reproducing rate comprising the steps of:

fetching means for fetching a plurality of pairs of neighboring two voice waveforms having the same length from a buffer memory in which voice waveform data of said input voice signal are stored, wherein a length of each pair of two waveforms is made different; and means for detecting a pair of voice waveforms in which a form difference between two waveforms is the minimum from a plurality of pairs of said voice waveforms fetched from said buffer memory.

14. A computer program product for operating a computer, said computer program comprising;

a computer readable media;

first program instruction means for instructing a computer processor to select neighboring two voice waveforms having the same length and the minimum form difference from voice waveforms of an input voice signal; and second program instruction means for instructing a computer processor to process to overlap said selected two voice waveforms; and wherein each of said program instruction means is recorded on said medium in executable form and is loadable into a computer memory for executing by the associated processor.

15. The computer program product for operating a computer according to claim 14, wherein said first program instruction comprising:

third program instruction means for instructing a computer processor to fetch a plurality of pairs of neighboring two voice waveforms having the same length from a buffer memory in which voice waveform data of said input voice signal are stored, wherein a length of each pair of two voice waveforms is made different; and fourth program instruction means for instructing a computer processor to detect a pair of voice waveforms in which a form difference between two waveforms is the minimum from a plurality of the pairs of the voice waveforms fetched by said third program instruction means from said buffer memory.

* * * * *